US006669048B2

(12) United States Patent
Eva et al.

(10) Patent No.: US 6,669,048 B2
(45) Date of Patent: Dec. 30, 2003

(54) NECK APPARATUS AND CLOSURE SYSTEM FOR A MULTI-COMPARTMENT BOTTLE

(75) Inventors: Ronald Robert Eva, Bahama, NC (US); Shannon M. Russell, Durham, NC (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 10/096,537

(22) Filed: Mar. 12, 2002

(65) Prior Publication Data

US 2003/0173364 A1 Sep. 18, 2003

(51) Int. Cl.[7] ..... B65D 1/36; B65D 25/04; B65D 1/04

(52) U.S. Cl. ..... 220/524; 220/259.3; 220/235; 220/375; 215/6; 215/296; 215/44

(58) Field of Search ..... 220/524, 375, 220/259.3, 255; 215/6, 306, 296, 44; 222/129, 94, 145.1, 543

(56) References Cited

U.S. PATENT DOCUMENTS

| | | | | | |
|---|---|---|---|---|---|
| 132,020 | A | * | 10/1872 | Odell | 215/6 |
| 341,337 | A | * | 5/1886 | Lewis | 222/482 |
| 3,262,612 | A | * | 7/1966 | Tabor | 222/484 |
| 3,337,073 | A | * | 8/1967 | Angelo | 215/6 |
| 3,705,661 | A | * | 12/1972 | Davis | 215/6 |
| 4,765,514 | A | * | 8/1988 | Berglund | 222/145.1 |
| D323,980 | S | * | 2/1992 | Perrin | D9/347 |
| 5,135,702 | A | * | 8/1992 | Eales | 264/516 |
| 5,154,917 | A | * | 10/1992 | Ibrahim et al. | 424/44 |
| 5,240,788 | A | * | 8/1993 | Eales | 429/156 |
| D361,509 | S | * | 8/1995 | Dull et al. | D9/347 |
| 5,447,245 | A | * | 9/1995 | Merhar | 215/6 |
| 6,390,324 | B1 | * | 5/2002 | Everette et al. | 220/555 |

* cited by examiner

*Primary Examiner*—Lee Young
*Assistant Examiner*—James Smalley
(74) *Attorney, Agent, or Firm*—Alston & Bird LLP

(57) ABSTRACT

A multi-compartment bottle is provided, the bottle comprising a body defining a plurality of compartments, with each compartment being adapted to contain an amount of a liquid. A neck finish, integral with the body, has an outer surface which defines an opening for and in communication with each respective compartment. Each opening is adapted to allow dispensing of the respective liquid therethrough. The outer surface of the neck finish defines a groove configured to discretely separate the openings such that the groove prevents liquid dispensed from one opening from entering another opening. The openings are further arranged so as to collectively define a substantially circular outer periphery for the neck finish. A closure system for the bottle comprises a plug for and configured to be separably engageable with each respective opening. The closure system also comprises a cap configured to be separably engageable with the neck finish so as to secure the plugs in engagement with the respective openings and prevent dispensing of the liquid through the openings.

26 Claims, 7 Drawing Sheets

NECK APPARATUS AND CLOSURE SYSTEM FOR A MULTI-COMPARTMENT BOTTLE

FIELD OF THE INVENTION

The present invention relates to bottles and, more particularly, to a neck apparatus/outlet design and closure system for a multi-compartment bottle.

DESCRIPTION OF RELATED ART

Agricultural chemicals such as, for example, herbicides, pesticides, fungicides, or the like, or other end use products such as, for example, detergents, cleaning aids, or the like, may commonly be provided in a liquid form for end use. Such liquid form products may also comprise two or more component liquids which must, in some instances, be combined according to a certain ratio in order to be effective for a specific purpose. In addition, for various reasons such as, for example, limited shelf life or compatibility, such two or more component liquid products cannot be combined until just prior to actual use. However, it may often be inconvenient or messy for the component liquids to be provided in separate bottles, wherein the component liquids must be manually measured and combined for the product to be used.

One solution for simplifying the use of two or more component liquid products has been to provide a multi-compartment bottle or container having a separate defined compartment for containing each of the respective liquid components, with the bottle being comprised of a material compatible with the liquid components. Such multi-compartment bottles may be configured to have, for example, a discrete capped outlet for each compartment or a single outlet having openings from the individual compartments extending therethrough, the openings from the individual compartments being encloseable under a single cap. Where a single compartment or a multi-compartment bottle uses a single neck configuration for the openings from the individual compartments each containing a liquid, the openings are typically sealed by a foil induction seal after the compartments have been filled with the respective liquids. Such induction seals are usually provided inside a cap configured to engage the outlet of the bottle. When the cap is installed on the bottle and subjected to microwave heating, the induction seal is released from the cap and sealed to the outlet of the bottle. The cap, such as a screw-type or snap-type cap, is thus engaged with the neck (otherwise referred to herein as an "outlet") so as to protect the induction seal and provide a mechanism for reclosing the bottle. However, such a closure configuration for the bottle may not be desirable for several reasons. For example, once the induction seal is removed from the neck, the liquid and air tight seal at the neck is broken since the cap, by itself, is typically not configured to provide such a seal. Accordingly, bottles sealed in this manner may be prone to leakage or evaporation of the compartment contents after the induction seal is removed. In some instances, oxygen-sensitive compartment contents may also be adversely affected by the lack of a suitably tight seal for the bottle.

The production of a multi-compartment bottle having a neck sealed with an induction seal may also be undesirable for several reasons. For example, in one process, the induction seal may be configured so as to have an activatable adhesive or other suitable material applied to the seal on the surface interacting with the neck of the bottle. An adhesive or other mechanism may then be applied to the opposite surface of the seal to secure the seal in the cap. Once the cap is applied to the neck of the bottle so as to engage the seal with the openings, the cap and the area of the bottle about the neck are heated by, for example, microwaves, so as to detach the seal from the cap. The heat also activates the adhesive to secure the seal to the neck and provide the liquid and air tight seal. However, such a process may be difficult to set up, operate, and maintain with consistency. For instance, if the heat is not sufficient, the adhesive may not properly secure the seal to the neck. In other instances, if the compartment contents spill on the neck during the compartment filling process, the adhesive may also fail to properly secure the seal to the neck. In still other instances, removal of the cap for inspection of the seal may also damage the seal if there is residual adherence between the seal and the cap.

Multi-compartment bottle employing a single neck configuration often have the neck configured such that the openings for the respective compartment are defined by a single flat surface comprising the liquid outlet surface of the neck. In this manner, the induction seal may be adhered to the flat surface about each opening such that a single sealing process is sufficient for sealing each of the openings. Once the seal is removed, the chemicals in the respective compartments can be poured out of the bottle. However, once the pouring process is completed, spillage may remain on the flat liquid outlet surface of the neck, wherein the spillage may drain into one or more of the openings and cause undesirable cross-contamination of the remaining chemicals in the respective compartments. Such a situation may also result in a safety hazard, for example, if a combination of insufficient quantities of two chemicals results in the release of excessive heat sufficient to damage the bottle and cause leakage. The described neck configuration may also be undesirable, for example, if the seal is removed and the user only desires to pour one of the chemicals from the container, since such containers typically do not include a provision for maintaining a liquid tight seal over some outlets while allowing liquid to be poured from other outlets.

Thus, there exists a need for a multi-compartment bottle having a single neck configured so as to minimize the risk of cross-contamination between compartments when the liquids are poured from the bottle. Further, such single-neck bottle should desirably include a closure system for providing a reusable liquid and/or air tight seal for each of the openings for the respective compartments, wherein the seal should also be readily and reliably applied in a simple operation during the bottle-filling process, as well as following each use of the bottle. In addition, such a closure system should desirably be configured so that, in some instances, liquid may be poured from one or more openings while other openings remained sealed with a liquid tight seal.

BRIEF SUMMARY OF THE INVENTION

The above and other needs are met by the present invention which, in one embodiment, provides a multi-compartment bottle comprising a body defining a plurality of compartments, with each compartment being adapted to contain an amount of a liquid. A neck finish, integral with the body, has an outer surface which defines an opening for and in communication with each respective compartment. Each opening is adapted to allow dispensing of the respective liquid therethrough. The outer surface of the neck finish defines a groove configured to discretely separate the openings such that the groove prevents liquid dispensed from one opening from entering another opening.

Another advantageous aspect of the present invention comprises a closure system adapted to be operably engaged with a bottle having a body defining multiple compartments. Such a closure system comprises a neck finish operably engaged with the body, the neck finish having an outer surface defining an opening for and in communicate with each respective compartment. Each opening is adapted to allow dispensing of the respective liquid therethrough. The closure system further comprises a plug for and configured to be separably engageable with each respective opening. The closure system also comprises a cap configured to be separably engageable with the neck finish so as to secure the plugs in engagement with the respective openings and prevent dispensing of the liquid through the openings.

Still another advantageous aspect of the present invention comprises a neck apparatus adapted to operably engage a bottle having a body defining multiple compartments. Such an apparatus comprises a neck finish operably engaged with the body and having an outer surface defining an opening for and in communication with each respective compartment. Each opening is adapted to allow dispensing of the liquid therethrough. The outer surface of the neck finish further defines a groove configured to discretely separate the openings such that the groove prevents liquid dispensed from one opening from entering another opening.

Thus, embodiments of the present invention provide a neck apparatus and closure system for a multi-compartment bottle configured so as to have a groove discretely separating the liquid outlet openings in order to minimize the risk of cross-contamination between compartments when the liquids are poured from the bottle. Further, embodiments of the present invention include a closure system providing a reusable liquid and/or air tight seal for each of the openings for the respective compartments. The plugs forming the seals may be readily and reliably applied in a simple operation during the bottle-filling process, as well as following each use of the bottle. In addition, embodiments of the present invention provide that the plugs may be configured to be selectively engageable with the desired openings such that liquid may be poured from one or more openings while other openings remain sealed with a liquid tight seal. Accordingly, embodiments of the present invention provide distinct advantages as detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
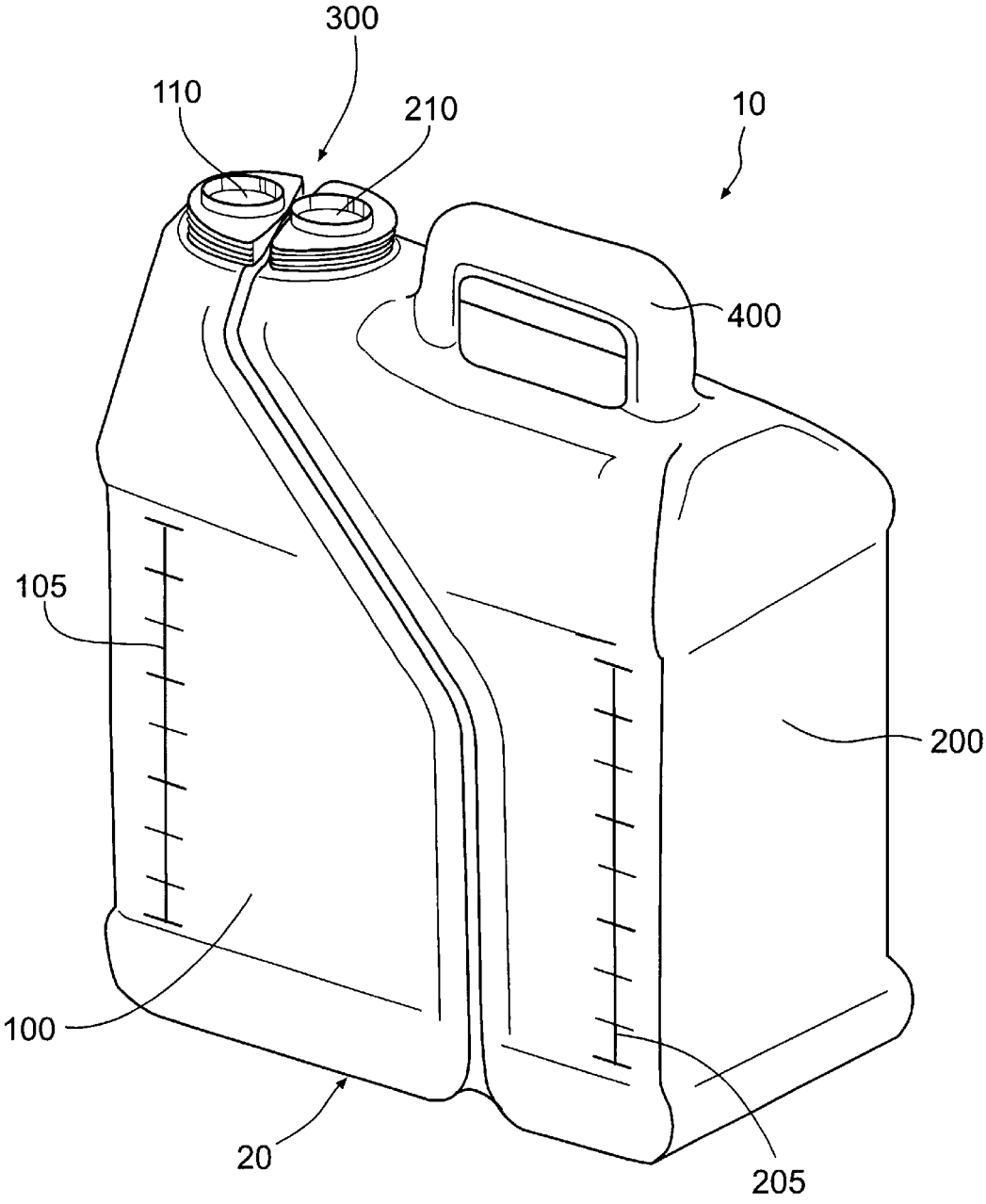
FIG. 1 is a perspective view of a multi-compartment bottle incorporating a neck and closure system according to one embodiment of the present invention.
Figure 2:
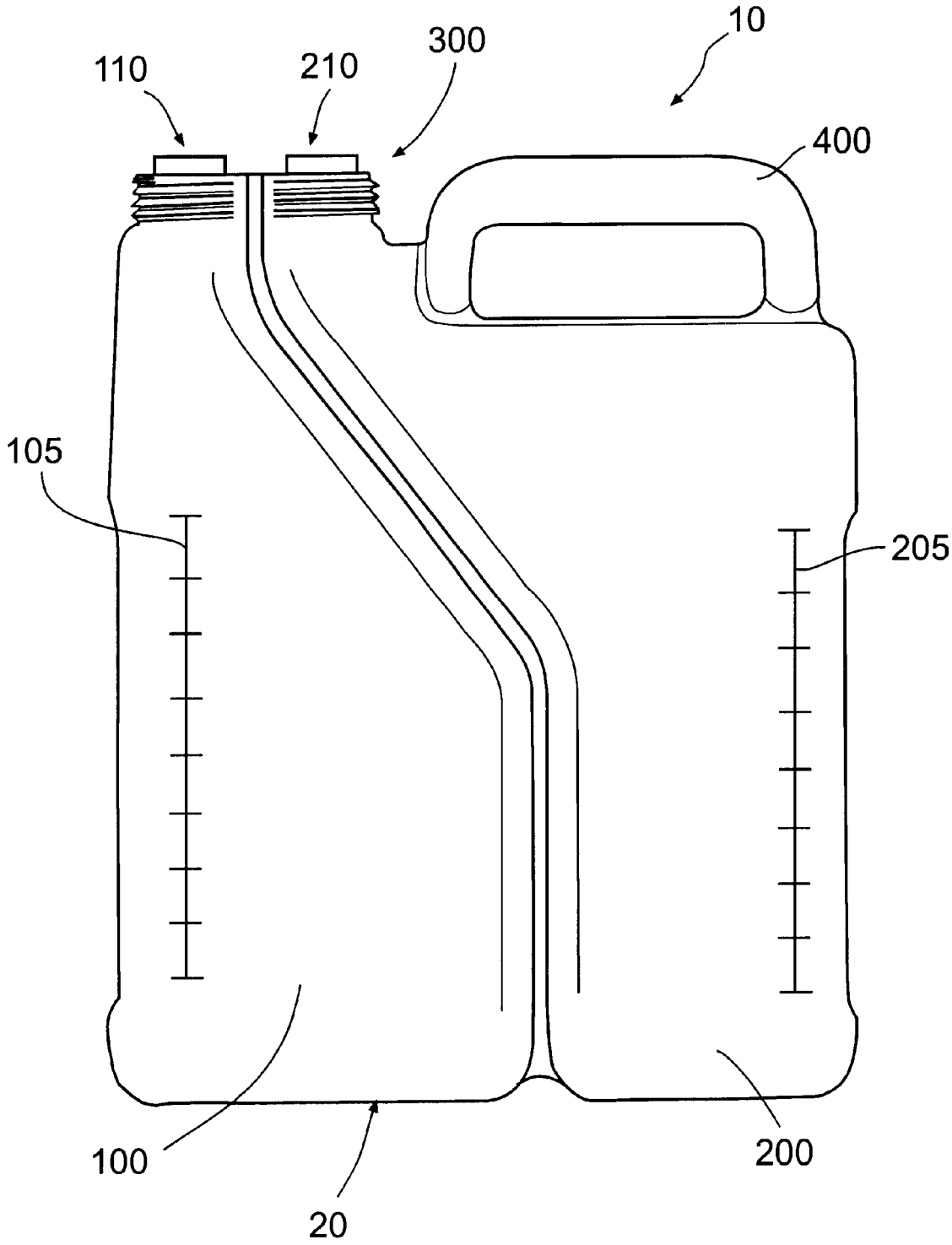
FIG. 2 is a side view of a multi-compartment bottle incorporating a neck and closure system according to one embodiment of the present invention.
Figure 3:
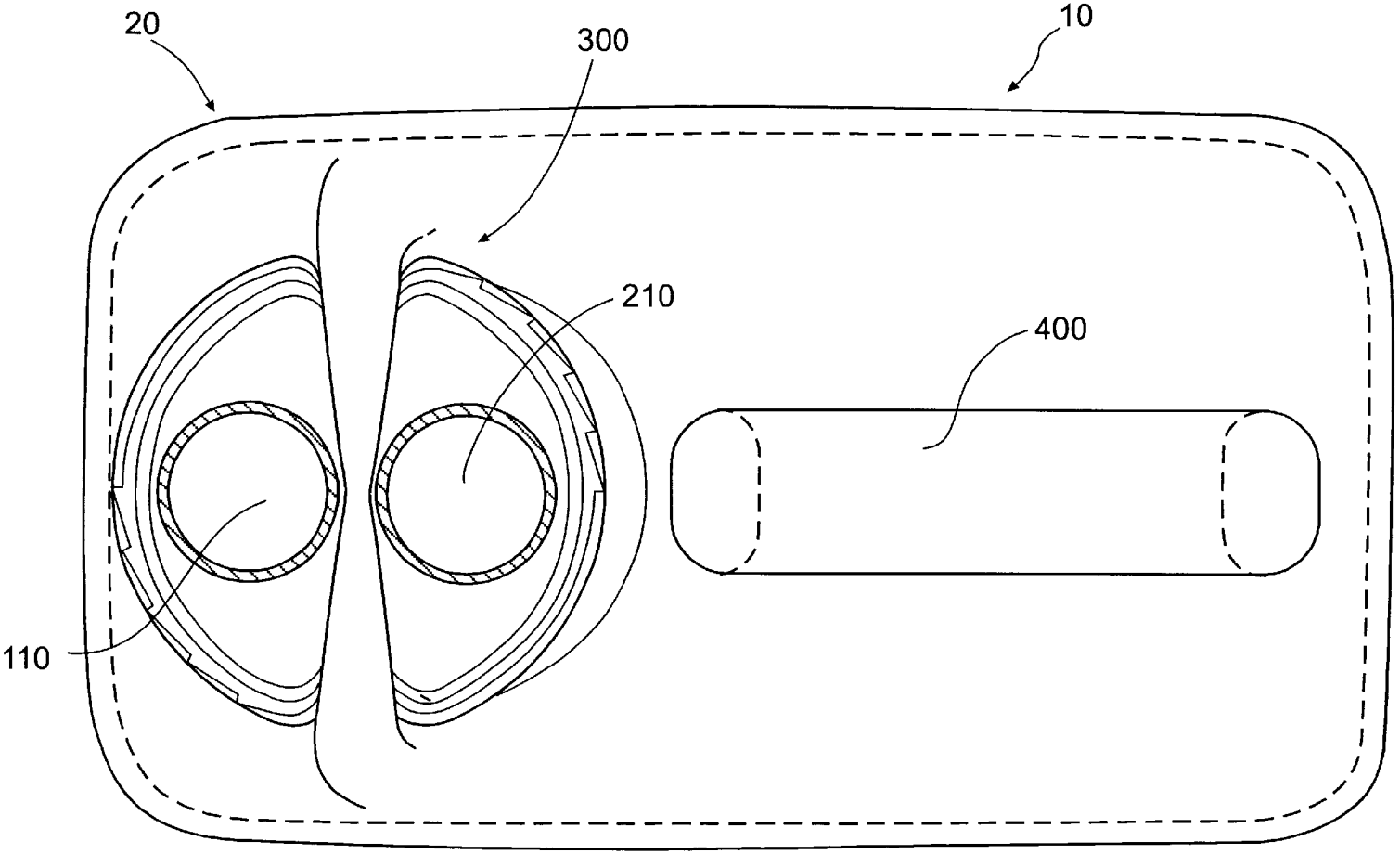
FIG. 3 is a plan view of a multi-compartment bottle incorporating a neck and closure system according to one embodiment of the present invention.

FIGS. 1–3 illustrate a multi-compartment bottle incorporating a neck and closure system according to one embodiment of the present invention, the bottle being indicated generally by the numeral 10. Note that, though the bottle 10 will be described herein in terms of comprising a body portion 20 defining two separate compartments 100, 200, it will be understood that the concepts described herein may also be readily applied in a similar manner to bottles defining more than two separate compartments. Accordingly, the configurations described herein are presented merely for the sake of example and are not intended to be limiting with respect to the range of configurations which are contemplated for embodiments of the present invention. Thus, as indicated, the bottle 10 comprises a body portion 20 defining separate compartments 100, 200 and includes a neck finish 300 in communication with the body portion 20 and each compartment 100, 200. The bottle 10 may also include a handle 400 attached to or formed integrally with the body portion 20. As will be appreciated by one skilled in the art, such a bottle 10 may be comprised of a plastic material such as, for example, high density polyethylene, and formed, for example, in a blow molding process by pinching the mold to form the individual compartments 100, 200. However, such a bottle 10 may be produced from a variety of other materials and processes depending on a number of factors such as, for example, the chemicals to be contained within the bottle 10, service conditions or requirements, or production costs or constraints. In addition, though embodiments of the present invention refer to the containment of agricultural chemicals such as, for example, herbicides, pesticides, fungicides, or the like, it will be understood that configurations of the bottle 10, as well as the neck and closure system associated therewith, may be applicable for any situation in which it is desirable to separately contain two or more liquids in a single bottle, wherein the liquids are intended for separate or combined use, such as, for example, end use products such as, for example, detergents, cleaning aids, or the like.

According to embodiments of the present invention, the compartments 100, 200 may be configured to hold equal amounts of the respective liquids or, in some instances, amounts of the respective liquids according to a ratio corresponding to the ideal mix of the liquids. For example, if the ideal mix ratio of two liquids is 2:1, one of the compartments 100, 200 may be configured to hold twice the amount of liquid as the other. According to some embodiments of the present invention, each of the compartments 100, 200 may include a measure indicator 105, 205 such as, for example, a graduated scale, for indicating the amount of liquid in each compartment 100, 200, wherein the implementation of such graduated scales will be appreciated by one skilled in the art. The compartments 100, 200 terminate at the neck finish 300, wherein the neck finish 300 may be formed integrally with the compartments 100, 200 defined by the body 20 or otherwise attached thereto. For each compartment 100, 200 defined by the body 20, the outer surface of the neck finish 300 defines a corresponding opening 110, 210 in communication with the respective compartment 100, 200. The openings 110, 210 are configured to allow a liquid to be introduced into the respective compartments 100, 200, as well as to allow the liquid to be dispensed therefrom. In some instances, the openings 110, 210 may be configured to dispense the liquids from the respective compartments 100, 200 according to a selected ratio such as, for example, according to flow rate. For example, the openings 110, 210 may be equally sized or one of the openings 110, 210 may be sized differently from the other so as to provide the desired dispensation ratio of the respective liquids.

Figure 4A:
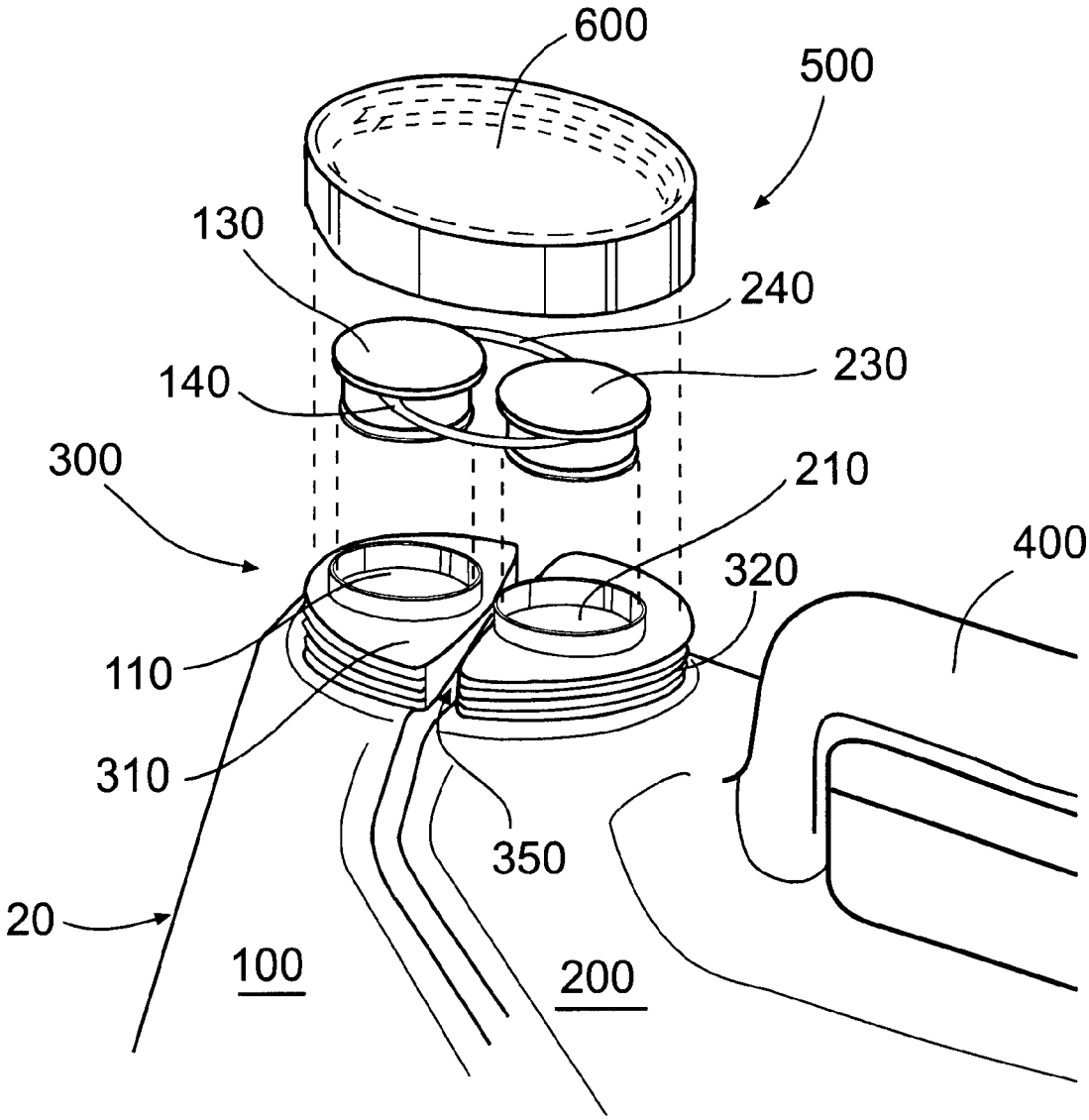
FIG. 4A is an exploded partial view of a neck and closure system for a multi-compartment bottle according to one embodiment of the present invention illustrating the plugs configured to separably engage the respective openings and the cap configured to secure the plugs in engagements with the openings.
Figure 4B:
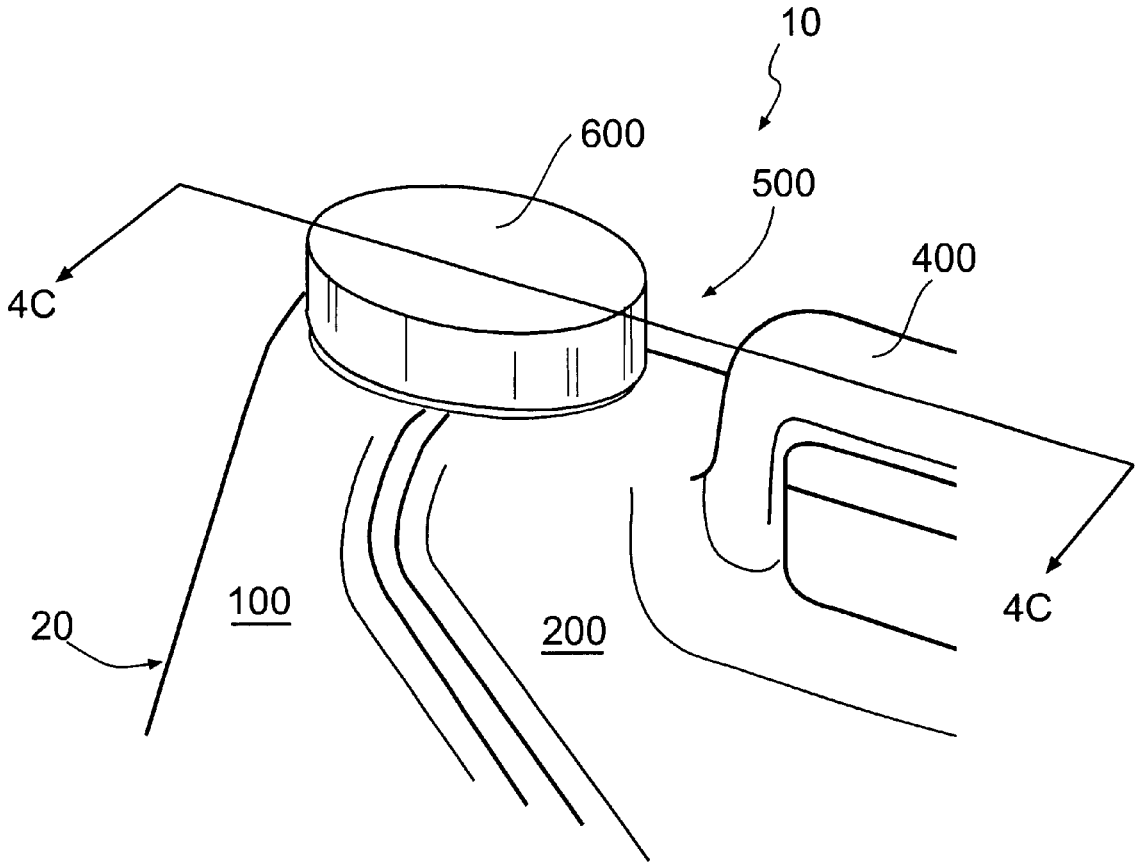
FIG. 4B is an exploded partial view of a neck and closure system for a multi-compartment bottle according to one embodiment of the present invention illustrating the plugs secured in the respective openings by the cap.
Figure 4C:
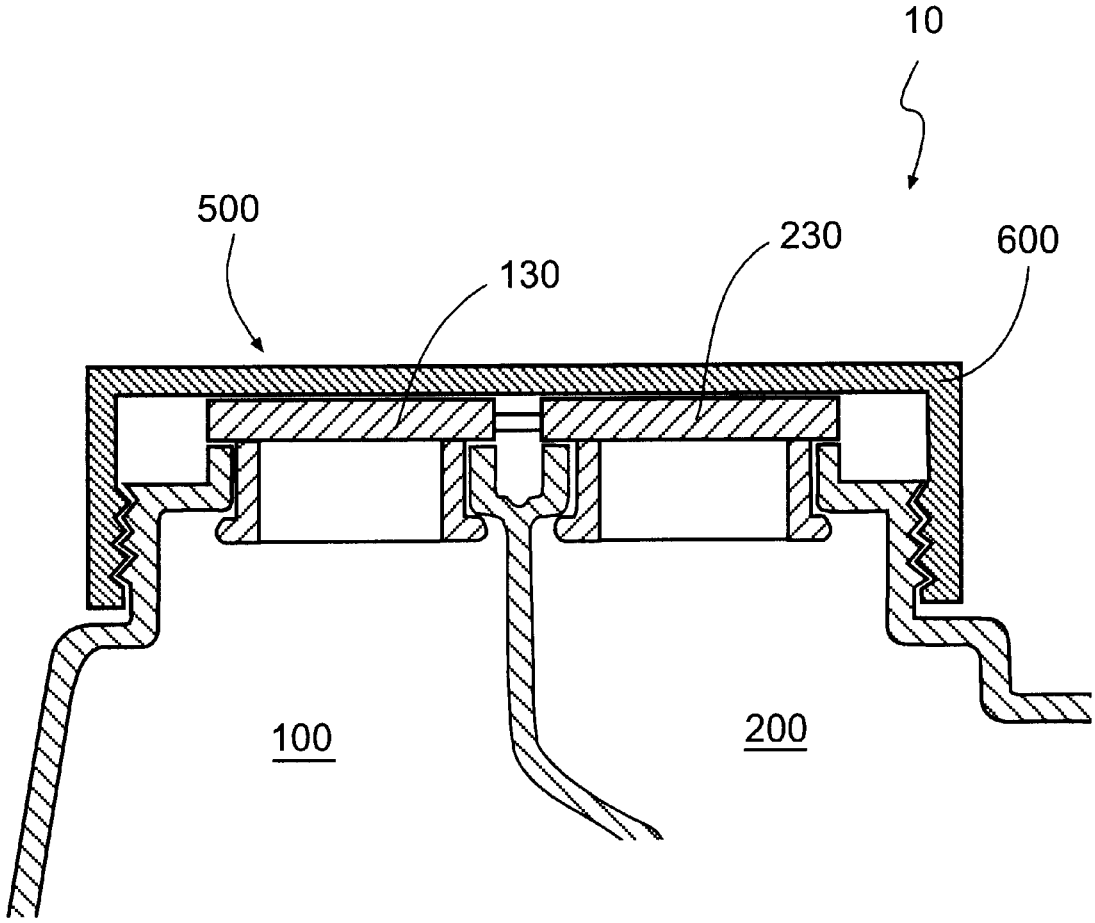
FIG. 4C is an exploded cross-sectional view of a neck and closure system for a multi-compartment bottle according to one embodiment of the present invention taken along line 4C—4C of FIG. 4B and illustrating the cap securing the plugs in engagement with the respective openings.

FIGS. 4A–4C more particularly illustrate the neck finish 300 and a closure system 500 for the bottle 10. As shown in FIG. 4A, the outer surface of the neck finish 300 terminates in a generally planar surface 310, which defines the openings 110, 210 for the respective compartments 100, 200, wherein the planar surface 310 is bounded by an outer periphery 320. However, as previously discussed herein, when dispensing the liquids from the compartments 100, 200, a flat surface between the openings 110, 210 increases the risk of cross-contamination since any spillage may run across the flat surface into one or more of the openings 110, 210. Accordingly, the outer surface of the neck finish 300 further defines a groove 350 extending toward the compartments 100, 200 and discretely separating the openings 110, 210. In instances where the outer surface of the neck finish 300 defines more than two openings, the groove 350 may be appropriately configured such that each opening is separated from the remaining openings by the groove 350. The groove 350 may be further configured to deepen, or extend further toward the compartments 100, 200, as the groove 350 approaches the outer periphery 320 such that any liquid entering the groove 350 will tend to run toward the outer periphery and drain along the sides of the body 20, thereby lowering the risk of cross-contamination.

According to embodiments of the present invention, the groove 350 divides the outer surface of the neck finish 300 into discrete portions 120, 220, each of which defines one of the openings 110, 210. The discrete portions 120, 220 are further configured and arranged so as to define a generally circular outer periphery 320 for the neck finish 300. As shown in FIGS. 4A–4C, the outer periphery 320 may be threaded so as to be capable of separably engaging a cap 600 having complementary threads so as to form one aspect of the closure system 500. However, the relation of the cap 600 to the neck finish 300 may take many different forms in order to accomplish the purpose of the cap 600 as is described further herein. For example, the cap 600 may be engaged with the neck finish 300 or other portion of the body 20 via a hinge mechanism (not shown), wherein the cap 600 may be separably secured over neck finish 300 with, for instance, a snap mechanism, as will be appreciated by one skilled in the art.

In some instances, the cap 600 may cooperate with the neck finish 300 to provide a reusable liquid and/or air tight seal over openings 110, 210 to form the closure system 500. However, such a configuration may be susceptible to the cap 600 being improperly applied such that the liquid and/or air tight seal is not attained. Accordingly, embodiments of the present invention further provide a closure system 500 having plugs 130, 230 configured to be separably engageable with the respective openings 110, 210 so as to individually provide liquid and/or air tight seals for each of the openings 110, 210 independently of or in cooperation with the cap 600, as shown in FIGS. 4B and 4C. The plugs 130, 230 may be comprised of a polymeric material such as, for example, high density polyethylene, like the bottle 10. However, the plugs 130, 230 may also be comprised of any material such as, for example, rubber, metal, or the like, suitable for providing the necessary liquid and/or air tight seal with the respective opening 110, 210, while also being non-reactive with the contents of the respective compartments 100, 200. The plugs 130, 230 may also have different forms such as, for example, hollow for reducing material amounts or weight, or solid for providing the necessary mechanical properties for providing a seal or for reusability.

Figure 5:
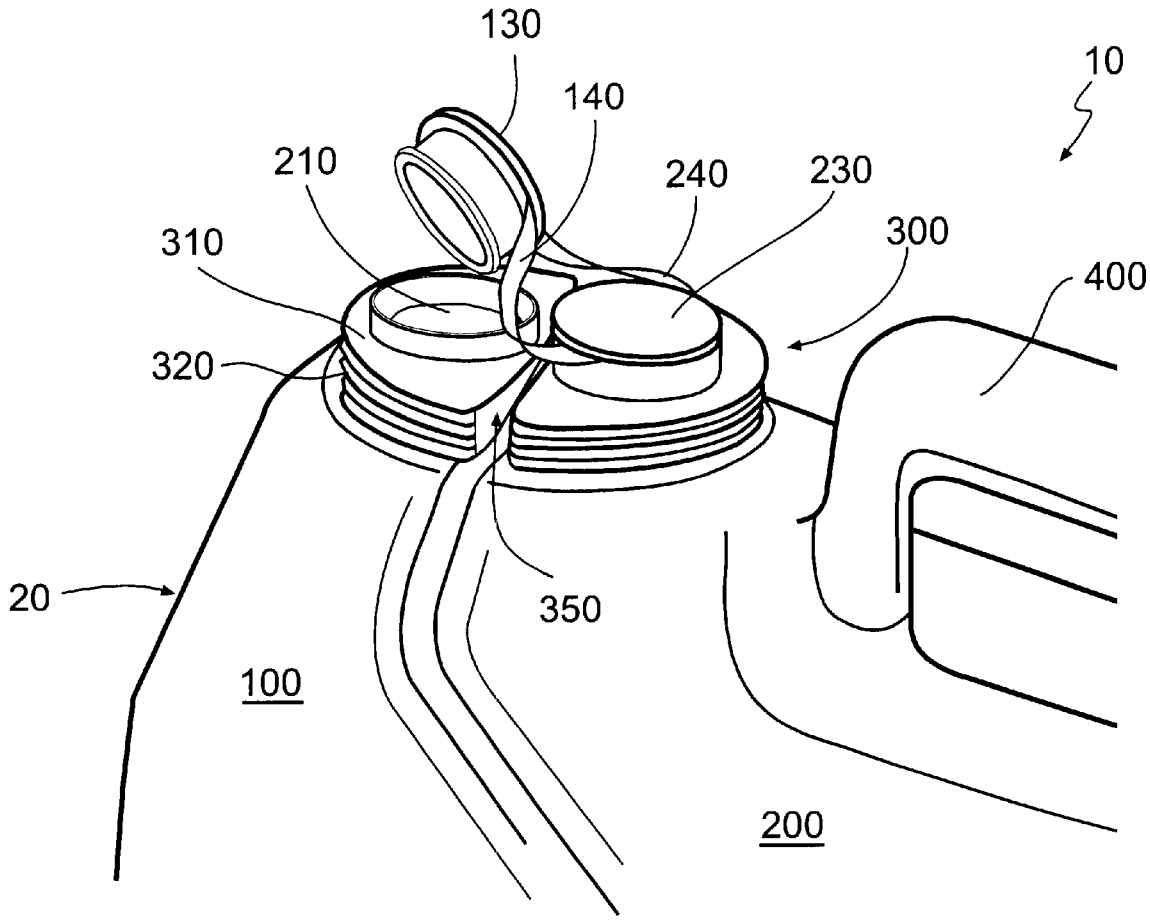
FIG. 5 is an exploded partial view of a neck and closure system for a multi-compartment bottle according to one embodiment of the present invention illustrating the plugs being selectively engaged with the desired openings.

In some instances, the plugs 130, 230 may be connected by one or more tethers (where two tethers 140, 240 are shown) formed integrally with or otherwise attached between the plugs 130, 230. The tethers 140, 240 may serve, for example, to facilitate the removal of the plugs 130, 230 from the openings 110, 210 or to keep the plugs 130, 230 together when removed from engagement with the openings 110, 210. As shown in FIG. 5, the tethers 140, 240 may also facilitate the selective removal of one plug 140 from the respective opening 110, while the other plug 240 remains engaged with the other respective opening 210 so as to allow the selective dispensing of liquids from on or more of the compartments. The plugs 130, 230 may be readily applied to the openings 110, 210 so as to provide the necessary liquid and/or air tight seal for each of the openings 110, 210 during the manufacturing process or after each use of the bottle 10. However, the use of the plugs 130, 230 alone may render the bottle 10 prone to, for example, tampering or accidental dislodgement of the plugs 130, 230. Accordingly, as further shown in FIGS. 4B and 4C, the cap 600 may be further configured so as to secure the plugs 130, 230 in liquid and/or air tight engagement with the respective openings 110, 210. For example, the cap 600 may be configured such that, when properly threadedly engaged with the neck finish 300, the plugs 130, 230 are not capable of being dislodged from sealing engagement with the respective openings 110, 210. The bottle 10 is thus less prone to leakage if the bottle 10 falls over, is compressed, or otherwise put in a position where the liquids may escape from the respective compartments 100, 200. One skilled in that art will also appreciate that tamper evident measures may also be readily applied to or integrated with the closure system 500.

Many modifications and other embodiments of the invention will come to mind to one skilled in the art to which this invention pertains having the benefit of the teachings presented in the foregoing descriptions and the associated drawings. For example, the illustrated bottle 10 is shown with the openings 110, 210 and the respective compartments 100, 200 being oriented along the direction of the length of the handle 400. However, in some instances, the bottle 10 may be partitioned along the direction of the length of the handle 400 such that the openings 110, 210 and the respective compartments 100, 200 are oriented transversely thereto. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multi-compartment bottle, comprising:

a body defining a plurality of compartments each adapted to contain an amount of a liquid; and a neck finish integral with the body and having an outer surface defining an opening for and in communication with each respective compartment, each opening being adapted to allow dispensing of the respective liquid therethrough, the outer surface of the neck finish defining a substantially circular threaded outer periphery, the outter surface of the neck finish above the outer periphery threads being generally planar and defining a groove configured to extend laterally between the openings so as to separate the outer surface into discrete portions, with each portion defining one of the openings and the portions being arranged so as to collectively define the outer periphery, to prevent the liquid dispensed from one opening from entering another opening.

2. A bottle according to claim 1 further comprising a plug for each respective opening, the plugs being configured to be separably engageable with the respective openings so as to prevent dispensing of the liquid therethrough.

3. A bottle according to claim 2 further comprising a tether operably engaged between at least two of the plugs, the tether being configured to facilitate disengagement of the plugs from the corresponding openings.

4. A bottle according to claim 2 wherein each plug is comprised of a material selected so as to be non-reactive with the liquid contained in the respective compartment.

5. A bottle according to claim 2 wherein the outer periphery is configured to accept a complementarily threaded cap such that threaded engagement of the cap with the neck finish secures the plugs in engagement with the corresponding openings.

6. A bottle according to claim 1 wherein the body and the neck finish are integrally formed in a blow-molding process.

7. A bottle according to claim 1 wherein the compartments defined by the body are adapted to contain liquid agricultural chemicals.

8. A bottle according to claim 1 further comprising a measure indicator operably engaged with each respective compartment of the body, each measure indicator being configured to indicate the amount of liquid in the corresponding compartment.

9. A bottle according to claim 1 wherein the measure indicator comprises a graduated scale.

10. A bottle according to claim 1 wherein the openings are configured so as to allow dispensing of the liquids from the respective compartments according to a selected ratio.

11. A bottle according to claim 1 wherein the openings are configured so as to allow dispensing of the liquids from the respective compartments according to a non-unitary ratio.

12. A bottle according to claim 1 wherein tile compartments defined by the body are configured to contain amounts of the respective liquids according to a selected ratio.

13. A bottle according to claim 1 wherein the compartments defined by the body are configured to contain amounts of the respective liquids according to a non-unitary ratio.

14. A closure system adapted to be operably engaged with a bottle having a body defining multiple compartments for containing an amount of a respective liquid, said system comprising:

a neck finish operably engaged with the body and having an outer surface defining an opening for and in communication with each respective compartment, each opening being adapted to allow dispensing of the respective liquid therethrough, the outer surface of the neck finish defining a substantially circular threaded outer periphery, the outer surface of the neck finish above the outer periphery threads being generally planar and defining a groove configured to extend laterally between the openings so as to separate the outer surface into discrete portions, with each portion defining one of the openings and the portions being arranged so as to collectively define the outer periphery, to prevent the liquid dispensed from one opening from entering another opening;

a plug for and configured to be separably engageable with each respective opening; and a cap configured to be complementarily threaded with respect to the threaded outer periphery of the neck finish such that threaded engagement of the cup with the neck finish secures the plugs in engagement with the respective openings and prevent dispensing of the liquid through the openings.

15. A system according to claim 14 further comprising a tether operably engaged between at least two of the plugs.

16. A system according to claim 14 wherein each plug is comprised of a material selected so as to be non-reactive with the liquid contained in the respective compartment.

17. A system according to claim 14 wherein the openings are configured so as to allow dispensing of the liquids from the respective compartments according to a selected ratio.

18. A system according to claim 14 wherein the openings are configured so as to allow dispensing of the liquids from the respective compartments according to a non-unitary ratio.

19. A system according to claim 14 wherein the outer surface of the neck finish further defines a groove configured to discretely separate the openings such that the groove prevents liquid dispensed from one opening from entering another opening.

20. A neck apparatus adapted to operably engage a bottle having a body defining multiple compartments for containing an amount of a respective liquid, said apparatus comprising:

a neck finish operably engaged with the body and having an outer surface defining an opening for and in communication with each respective compartment, each opening being adapted to allow dispensing of the respective liquid therethrough, the outer surface of the neck finish further defining a substantially circular threaded outer periphery, the outer surface of the neck finish above the outer periphery threads being generally planar and defining a groove configured to extend laterally between the openings so as to separate the outer surface into discrete portions, with each portion defining one of the openings and the portions being arranged so as to collectively define the outer periphery, to prevent the liquid dispensed from one opening from entering another opening.

21. An apparatus according to claim 20 further comprising a plug for each respective opening, the plugs being configured to be separably engageable with the respective openings so as to prevent dispensing of the liquid therethrough.

22. An apparatus according to claim 21 further comprising a tether operably engaged between at least two of the plugs, the tether being configured to facilitate disengagement of the plugs from the corresponding openings.

23. An apparatus according to claim 21 wherein each plug is comprised of a material selected so as to be non-reactive with the liquid contained in the respective compartment.

24. An apparatus according to claim 20 wherein the outer periphery is configured to accept a complementarily threaded cap such that threaded engagement of the cap with the neck finish secures the plugs in egagement with the corresponding openings.

25. An apparatus according to claim 20 wherein the openings are configured so as to allow dispensing of the liquids from the respective compartments according to a selected ratio.

26. An apparatus according to claim 20 wherein the openings are configured so as to allow dispensing of the liquids from the respective compartments according to a non-unitary ratio.

* * * * *